US006802085B2

(12) United States Patent
Catanescu et al.

(10) Patent No.: US 6,802,085 B2
(45) Date of Patent: Oct. 12, 2004

(54) METHOD AND APPARATUS FOR DISPOSING OF WASTE

(76) Inventors: Florea Catanescu, 8236 Holly Oaks St., Citrus Heights, CA (US) 95610; Georgeta Butoi, 8236 Holly Oaks St., Citrus Heights, CA (US) 95610

( * ) Notice: Subject to any disclaimer, the term of this patent is extended or adjusted under 35 U.S.C. 154(b) by 8 days.

(21) Appl. No.: 10/155,939

(22) Filed: May 25, 2002

(65) Prior Publication Data

US 2003/0217409 A1 Nov. 27, 2003

(51) Int. Cl.[7] ..... A47K 11/02
(52) U.S. Cl. ..... 4/471; 4/479
(58) Field of Search ..... 4/460, 471, 479, 4/484, 449, 315

(56) References Cited

U.S. PATENT DOCUMENTS 3,566,419 A * 3/1971 Danko ..... 4/471
4,823,412 A * 4/1989 Spiegel ..... 4/483

* cited by examiner

*Primary Examiner*—Gregory L. Huson
*Assistant Examiner*—Kathleen J. Prunner
(74) *Attorney, Agent, or Firm*—Davis & Associates; William D. Davis

(57) ABSTRACT

A portable waste disposal apparatus includes a stand for receiving a portable bowl and a waste container. The portable bowl includes a receiving port and a disposal port. A disposal port cover permits waste to pass when the cover is in an open position. Waste is prevented from passing through the disposal port when the cover is in a closed position. Actuation of the disposal port cover is independent of pressure within the portable bowl (e.g., due to waste, water, or purging fluid). In various embodiments, the cover slides or pivots between the open and closed positions. A method of disposing of waste includes the step of receiving waste into the portable bowl through the receiving port. The portable bowl is positioned to receive toilet purging fluid through the receiving port when placed within a toilet. The toilet is flushed to discharge the received purging fluid and waste through the disposal port of the portable bowl. In various embodiments, the portable bowl is placed within a waste container when transporting the portable bowl between the toilet and a stand.

26 Claims, 3 Drawing Sheets

METHOD AND APPARATUS FOR DISPOSING OF WASTE

FIELD OF THE INVENTION

The invention relates to methods and apparatus for disposing of waste. In particular, the invention is drawn to a portable waste collection apparatus that facilitates transport of the waste from a portable toilet to a fixed toilet coupled to a conventional waste transport system.

BACKGROUND OF THE INVENTION

Conventional waste disposal systems are designed to collect and transport human waste product such as feces and urine to a treatment facility or disposal site. A waste disposal system typically includes a mounted or fixed toilet for collection of waste and sewage lines for transport of the waste. In municipalities, for example, the fixed toilet is coupled to a sewer system that transports the waste to a distant waste processing facility. In less populated areas, the fixed toilet is coupled to a septic system for handling the waste. Septic systems transport the waste to an area near the collection point. The waste may be subsequently collected and processed remotely or the waste may be processed within the septic system. The fixed toilet serves as the waste collection device for both the sewer system and the septic system.

The fixed toilet is designed to isolate humans from the waste and the waste transportation and disposal system for sanitary reasons. Sanitary conditions can be compromised when individuals are incapacitated and are unable to use the fixed toilet system directly. These situations are prevalent in hospital, care home, and nursing home situations. In these areas, if patients or residents cannot utilize the toilets, a portable toilet is usually employed as an interim means for deposit of waste. These interim collection devices must then be transported to a fixed toilet system, emptied into the fixed toilet and then cleaned in order to maintain a sanitary environment.

One disadvantage of typical portable toilet designs is that the design frustrates emptying and cleaning without unsanitary splashing during disposal and cleaning. Dumping the waste products from the portable toilet into a fixed toilet tends to result in splashing. Subsequent attempts to clean either the portable toilet bucket with water also tends to result in splashing. These splashing actions broadcast waste product and thus frustrate the maintenance of sanitary conditions. In addition, the splashing tends to create additional mess that is undesirable to manually clean.

SUMMARY OF THE INVENTION

In view of known systems and methods, methods and apparatus for disposing of waste products are described.

A portable waste disposal apparatus includes a stand for receiving a portable bowl and a waste container. The portable bowl includes a receiving port and a disposal port.

A disposal port cover permits waste to pass through the disposal port when the cover is in an open position. Waste is prevented from passing through the disposal port when the cover is in a closed position. Actuation of the disposal port cover is independent of pressure within the portable bowl. In various embodiments, the cover slides or pivots between the open and closed positions.

A method of disposing of waste includes the step of receiving waste into the portable bowl through the receiving port. The portable bowl is positioned to receive toilet purging fluid through the receiving port when placed within a fixed toilet. The fixed toilet is flushed to discharge the received purging fluid and waste through a disposal port of the portable bowl. In various embodiments, the portable bowl is placed within a waste container for collection of waste and waste transport between the toilet and the stand.

DESCRIPTION OF THE DRAWINGS

The present invention is illustrated by way of example and not limitation in the figures of the accompanying drawings, in which like references indicate similar elements and in which.

DETAILED DESCRIPTION

Figure 1:
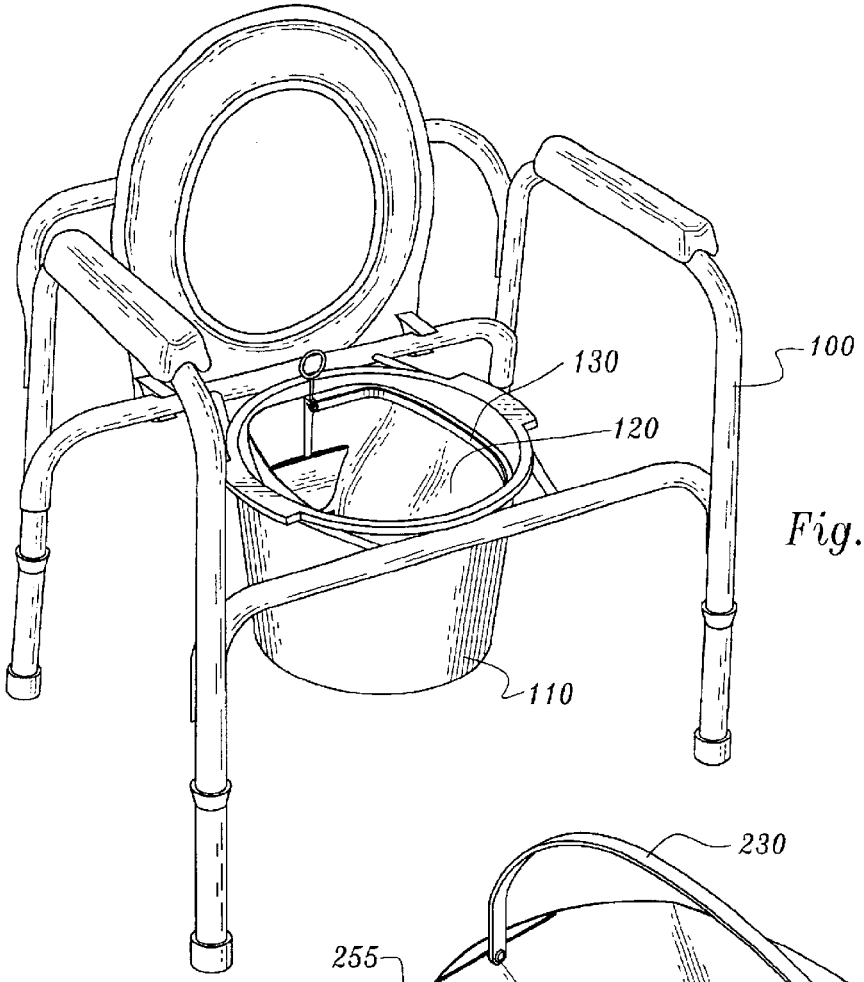
FIG. 1 shows one embodiment of a portable waste collection device with a portable waste collection container and a removable bowl.

FIG. 1 shows one embodiment of a portable waste disposal apparatus designed to facilitate waste disposal in conjunction with a fixed toilet. In this embodiment, a portable waste collection apparatus includes a stand 100. The stand 100 is designed to provide an ergonomic interface for the user. Stand 100 receives portable waste container 110 which in turn receives portable removable bowl 120. The term "bowl" is not intended to limit the shape of the element. Portable bowl 120 receives waste such as feces, urine, vomit, etc. Once collected, the waste product can be transported to a conventional waste disposal device such as a fixed toilet.

Figure 2:
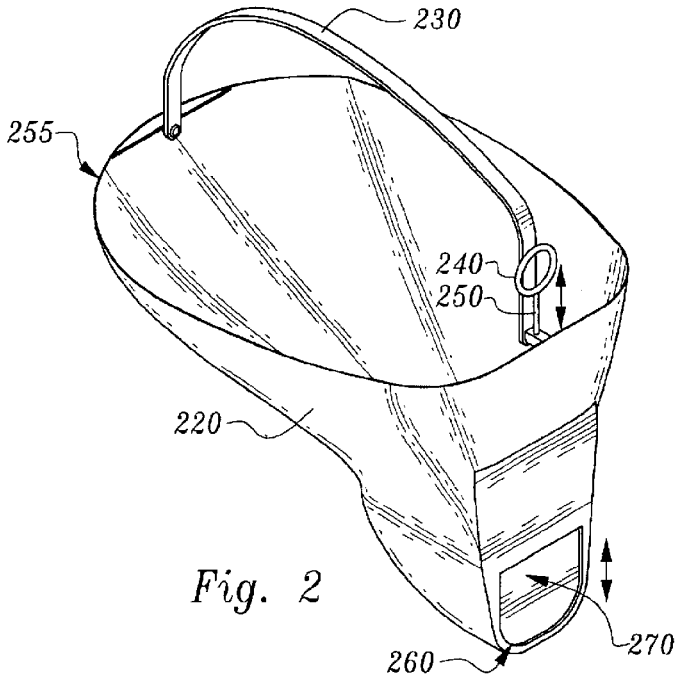
FIG. 2 displays one embodiment of a portable bowl to be used with a fixed toilet.

FIG. 2 provides a detailed view of portable bowl 220. The portable bowl includes a first port 255 and a distinct smaller second port 260. The first port is defined by a larger opening than the second port. The first port is a waste receiving port 255 for collecting waste into the interior of the portable bowl. The second port is the waste disposal port 260 designed to allow waste to be moved from the interior to the exterior of the portable bowl. In one embodiment, the portable bowl 220 includes a handle 230 that facilitates lifting and carrying the portable bowl during transport. Referring to FIG. 1, the handle 130 may be positioned out of the way of the waste collection port when using the portable waste disposal apparatus.

Figure 5:
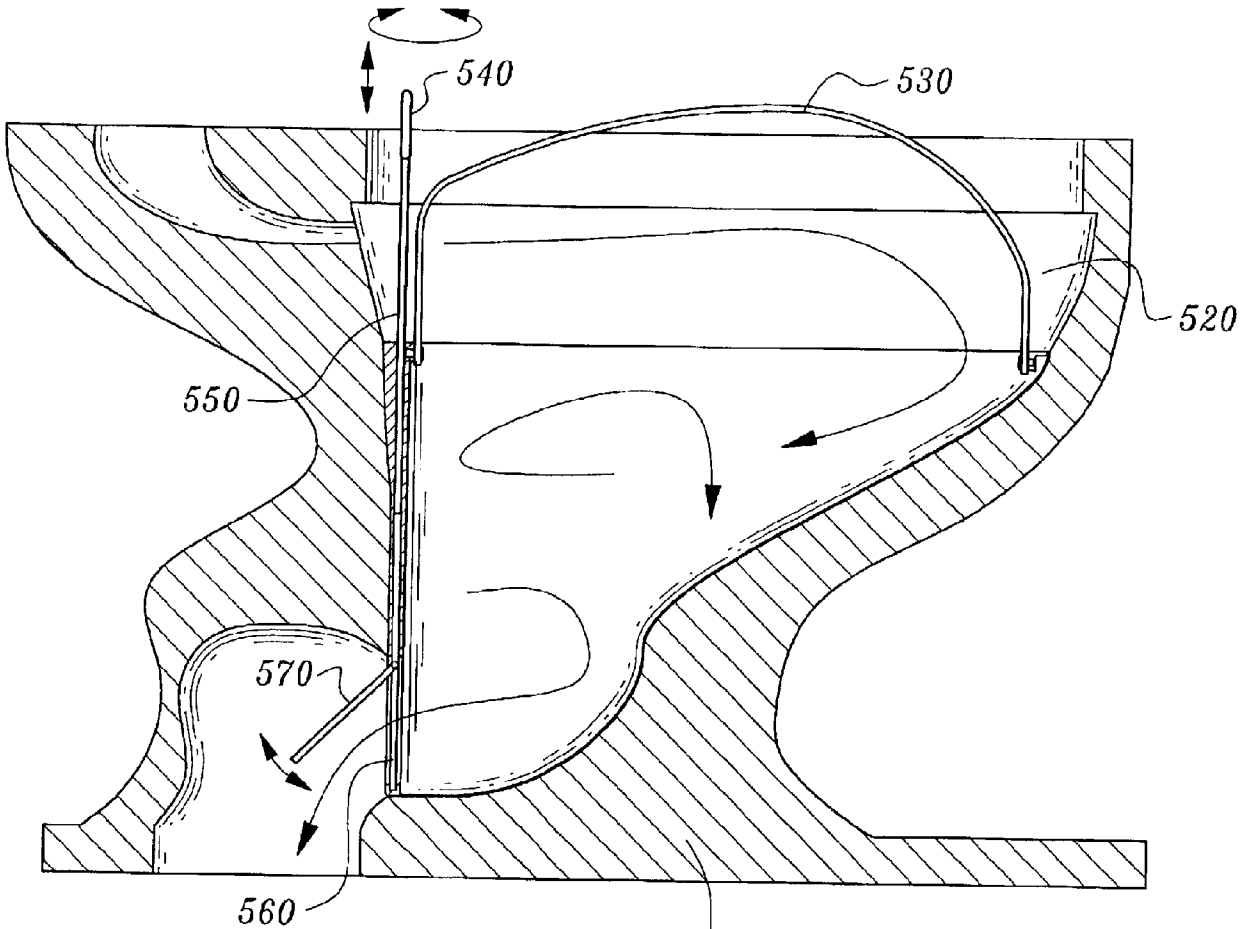
FIG. 5 provides a cross-section of the portable bowl positioned within a fixed toilet bowl.

Referring again to FIG. 2, the waste disposal port is equipped with a cover 270 which can be opened and closed in one embodiment cover 270 slides open and closed through the use of a pulling aid 240 and connecting rod 250. Thus, for example, longitudinal movement of the connecting rod slides the cover open or closed. In an alternative embodiment, cover 270 pivots to open and close as illustrated in FIG. 5. This might be accomplished by either twisting or longitudinal movement of the pulling aid depending upon the mechanical coupling to the pivoting cover 570. Waste may be purged from the interior to the exterior of the portable bowl through the disposal port when the cover is in the open position. Waste is not permitted to pass through the disposal port when the cover is in the closed position. The disposal port and disposal port cover are alternately referred to as the discharge port and discharge port cover respectively.

Figure 3:
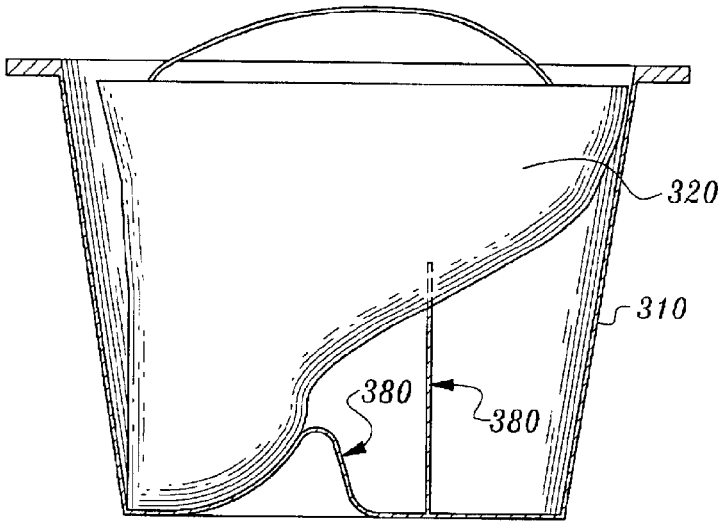
FIG. 3 provides a cross-section of a portable bowl oriented in a portable waste collection container.

FIG. 3 illustrates a cross-section of the portable waste container 310 and portable bowl 320. In this embodiment, the portable waste container includes supports 380 complementary to the shape of the portable bowl to provide support and to limit movement of the portable bowl 320 within the portable waste container 310. Preferably, the waste container and portable bowl are transported together to a fixed toilet system in order to ensure any leakage from the portable bowl is adequately contained within the waste container.

Figure 4:
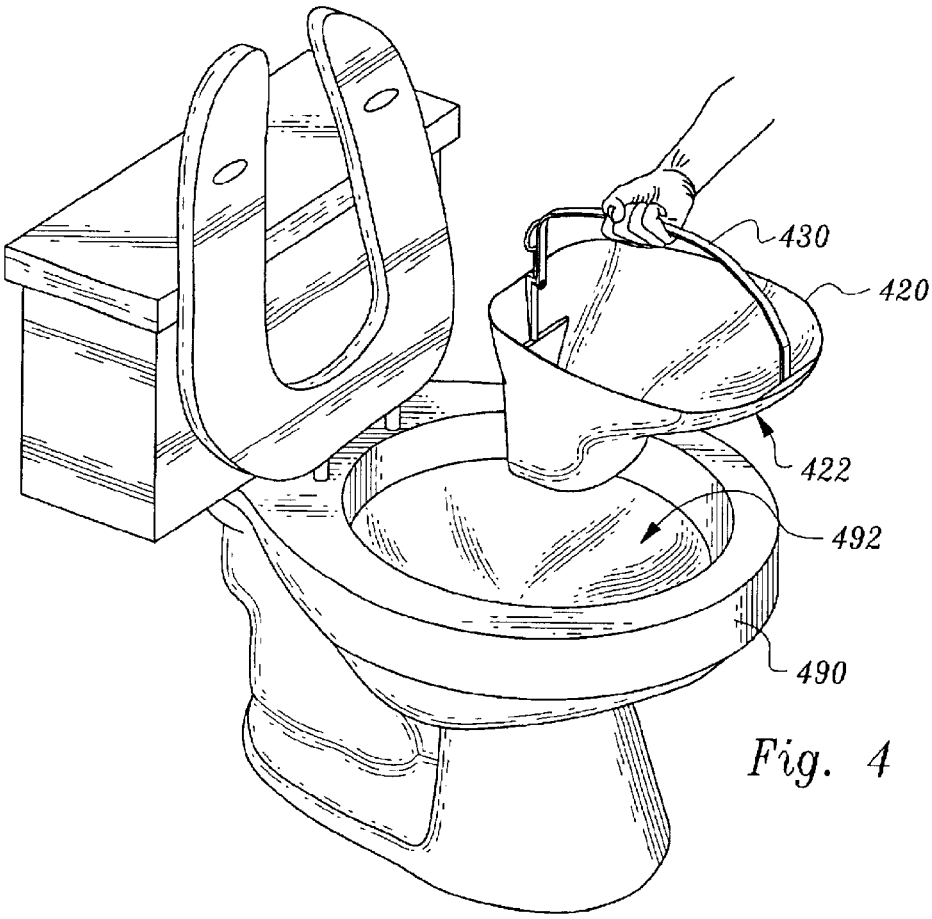
FIG. 4 illustrates one embodiment of a method of using the portable bowl.

Referring to FIG. 4, once the portable bowl containing the waste product has been transported to the fixed toilet 490, the portable bowl 420 can then be placed into the bowl of the fixed toilet for disposal of the waste product. Handle 430 may be used to position the portable bowl within the fixed bowl of the toilet.

In one embodiment, at least a portion 422 of the outer surface of the portable bowl 420 has a shape complementary to the shape of a corresponding portion 492 of the interior of the bowl of the fixed toilet. In one embodiment, the portable bowl is fabricated from a flexible material that permits the portable bowl to deform upon application of pressure to a shape complementary to the shape of a corresponding portion of the interior of the bowl of the fixed toilet.

Generally, the greater the area of the outer surface of the portable bowl 420 that conforms to the shape of the interior of the bowl of the fixed toilet, the better the flushing and cleansing action will be within the portable bowl. The amount of contact necessary to collect sufficient re-supply water during the flush action is dependent upon the design of the fixed toilet. Some toilets, for example, supply a majority of the re-supply water to a small region near the front of the toilet bowl. Thus the outer surface of the portable bowl may need only to conform to the fixed bowl interior area around where the majority of the re-supply water is introduced.

In another embodiment, substantially the entirety of the outer surface of the portable bowl conforms to the shape of the inner surface of the fixed toilet bowl. External areas of the portable bowl around the area of the discharge port do not necessarily need to conform to the fixed toilet bowl because there generally will not be any significant flushing actions in such areas.

In various embodiments, the portable bowl is composed of a semi-rigid plastic material. The interior of the portable bowl should be smooth and non-stick to ensure ease of waste removal and cleaning with the flush action.

FIG. 5 illustrates a cross-section of the portable bowl 520 positioned inside the bowl of fixed toilet 590. The portable bowl 520 includes a handle 530. a waste disposal port 560, a cover 570, and a pulling aid 540. In this position, the waste discharge port cover 570 may be opened to facilitate purging of the waste product from the portable bowl 520 through the waste disposal port 560. Typical fixed toilets have a valve that is actuated by water pressure once the volume of water in the fixed toilet bowl exceeds a pre-determined threshold. In one embodiment, actuation of the discharge port cover is independent of pressure (e.g., due to waste, water, or purging fluid) within the portable bowl. In one embodiment, the discharge port cover is manually opened with a pulling action on the pulling aid 540 that is attached to the cover 570 with a connecting rod 550. Alternatively, the discharge port cover is manually opened with a twisting action on the pulling aid 540.

The portable bowl is positioned within the fixed toilet bowl to permit the re-supply water to enter the portable bowl. The re-supply water acts as purging fluid. A standard toilet flush action introduces re-supply water into the fixed toilet bowl and thus into the portable bowl. Typically the flush action results from the conversion of potential energy into kinetic energy when the re-supply water is released from a storage area above the fixed toilet bowl.

The re-supply water purges the waste product from the portable bowl through the discharge port when the cover is open. In one embodiment, the disposal port cover forms a one-way valve for passing waste substantially only in one direction through the disposal port when the valve is open.

Once the waste product has been purged, the discharge port cover is closed before removing the portable bowl from the fixed toilet bowl. The portable bowl is then placed in the portable waste container to capture any remaining water during transport. The portable container and portable bowl are then returned to the stand. The portable waste container serves as a containment vessel for any leakage from the interior of the portable bowl as well as water on the exterior surface of the portable bowl resulting from the flushing action.

Previously, the disposal of waste from a prior art portable bucket toilet included the tasks of (1) adding water to the bucket to ensure that the waste will be removed; (2) dumping the bucket contents into the fixed bowl; and (3) cleaning the bucket. These tasks were performed outside of the volume of the fixed toilet bowl and thus resulted in contamination that spread beyond the immediate area of the fixed toilet. The individual responsible for performing these tasks is particularly susceptible to contamination resulting from such practices. In contrast, the three tasks can now be performed within the interior of the fixed bowl. All three tasks are accomplished with a flush of the fixed toilet. In particular, the splash previously encountered when dumping waste product is substantially eliminated or reduced because the waste is being discharged through the discharge port located well within the bowl of the fixed toilet as opposed to being dumped from a height well above the fixed toilet bowl. Any splash resulting from the introduction of the re-supply water into the portable bowl is contained within the fixed toilet bowl which was designed for handling the tasks.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. A portable waste disposal apparatus comprising:

a portable bowl having a receiving port to receive waste and a disposal port to discharge waste, wherein at least a portion of an exterior of the portable bowl has a shape complementary to a corresponding interior surface of a fixed toilet bowl; and a disposal port cover, wherein waste is permitted to pass through the disposal port when the cover is in an open position, wherein waste is prevented from passing through the disposal port when the cover is in a closed position, wherein actuation of the disposal port cover is independent of pressure within the portable bowl.

2. The apparatus of claim 1 further comprising:

a waste container for receiving the portable bowl.

3. The apparatus of claim 2 further comprising:

a stand for receiving the waste container.

4. The apparatus of claim 1 wherein the disposal port cover forms a one-way valve for passing waste substantially only in one direction through the disposal port when the valve is open.

5. The apparatus of claim 1 wherein the disposal port cover slides between the open and closed positions.

6. The apparatus of claim 5 further comprising a pulling aid coupled to the disposal port cover to facilitate sliding the disposal port cover between the open and closed positions.

7. The apparatus of claim 1 wherein the disposal port cover pivots between the open and closed positions.

8. The apparatus in claim 1 wherein the portable bowl further comprises a handle.

9. A method of waste disposal, comprising the steps of:

a) receiving waste through a receiving port of a portable bowl;

b) positioning the portable bowl at least partially within a fixed toilet so as to permit the re-supply water of the fixed toilet to enter the portable bowl through the receiving port; and c) flushing the toilet to provide the portable bowl with the re-supply water such that the re-supply water provides a toilet purging fluid through the receiving port, wherein the toilet purging fluid carries the waste out of the portable bowl through a discharge port of the portable bowl.

10. The method of claim 9 further comprising the step of:

d) opening the discharge port before step c).

11. The method of claim 10 wherein step d) further comprises the step of pivoting a discharge port cover to an open position.

12. The method of claim 11 wherein step e) further comprises the step of sliding a discharge port cover to a closed position.

13. The method of claim 10 wherein step d) further comprises the step of sliding a discharge port cover to an open position.

14. The method of claim 9 wherein step b) further comprises the step of:

i) transporting the portable bowl to the toilet, wherein the portable bowl is substantially disposed within a waste container during transport.

15. The method of claim 14 wherein step b) further comprises the step of:

ii) moving the portable bowl from the waste container to the toilet.

16. The method of claim 9 further comprising the step of:

e) closing the discharge port.

17. The method of claim 16 wherein step e) further comprises the step of pivoting a discharge port cover to a closed position.

18. The method of claim 9 further comprising the step of:

e) positioning the portable bowl within a waste container for transport.

19. A portable waste disposal apparatus, comprising:

a portable bowl having a receiving port to receive waste and a disposal port to discharge waste, the portable bowl constructed of a flexible material to enable at least a portion of an exterior surface of the portable bowl to conform to a corresponding complementary portion of the interior surface of a fixed toilet bowl; and a disposal port cover, wherein waste is permitted to pass through the disposal port when the cover is in an open position, wherein waste is prevented from passing through the disposal port when the cover is in a closed position. wherein actuation of the disposal port cover is independent of pressure within the portable bowl.

20. The apparatus of claim 19 further comprising a waste container for receiving the portable bowl.

21. The apparatus of claim 20 further comprising a stand for receiving the waste container.

22. The apparatus of claim 19 wherein the disposal port cover forms a one-way valve for passing waste substantially only in one direction through the disposal port when the valve is open.

23. The apparatus of claim 19 wherein the disposal port cover slides between the open and closed positions.

24. The apparatus of claim 23 further comprising a pulling aid coupled to the disposal port cover to facilitate sliding the disposal port cover between the open and closed positions.

25. The apparatus of claim 19 wherein the disposal port cover pivots between the open and closed positions.

26. The apparatus in claim 19 wherein the portable bowl further comprises a handle.

* * * * *